US007731315B2

(12) United States Patent
Lee et al.

(10) Patent No.: US 7,731,315 B2
(45) Date of Patent: Jun. 8, 2010

(54) REFRIGERATOR

(75) Inventors: Byung Kil Lee, Gwangju (KR); Geun Ho Her, Gwangju (KR); Chun Young Oh, Gwangju (KR); Jin Su Lee, Gwangju (KR); Min Jung Kim, Gwangju (KR)

(73) Assignee: Samsung Gwangju Electronics Co., Ltd., Gwangju (KR)

( * ) Notice: Subject to any disclaimer, the term of this patent is extended or adjusted under 35 U.S.C. 154(b) by 212 days.

(21) Appl. No.: 11/946,379

(22) Filed: Nov. 28, 2007

(65) Prior Publication Data

US 2008/0180013 A1 Jul. 31, 2008

(30) Foreign Application Priority Data

Jan. 26, 2007 (KR) ..... 10-2007-0008508

(51) Int. Cl.
*A47B 96/04* (2006.01)

(52) U.S. Cl. ..... 312/406

(58) Field of Classification Search ..... 312/400, 312/401, 406

See application file for complete search history.

(56) References Cited

U.S. PATENT DOCUMENTS 2,626,733 A * 1/1953 Maxwell et al. ..... 223/57
2,826,388 A * 3/1958 Janos et al. ..... 248/239
3,179,367 A * 4/1965 Rapata ..... 248/239
3,264,699 A * 8/1966 Knowlton ..... 24/305
3,917,206 A * 11/1975 Fisher ..... 248/239
4,716,633 A * 1/1988 Rizo ..... 24/453
5,238,299 A * 8/1993 McKinney ..... 312/223.6
5,570,984 A * 11/1996 Reznikov et al. ..... 411/551
6,612,671 B2 * 9/2003 Disbennett et al. ..... 312/408
6,612,795 B2 * 9/2003 Kirchen ..... 411/508
6,729,705 B2 * 5/2004 Wolanin et al. ..... 312/408
7,186,068 B2 * 3/2007 Zoubek et al. ..... 411/510
2007/0240395 A9 * 10/2007 Kentner et al. ..... 55/507

FOREIGN PATENT DOCUMENTS

JP 11-062921 3/1999
WO WO05/78365 8/2005

* cited by examiner

*Primary Examiner*—Janet M Wilkens
*Assistant Examiner*—Dan Rohrhoff
(74) *Attorney, Agent, or Firm*—Ohlandt, Greeley, Ruggiero & Perle, L.L.P.

(57) ABSTRACT

A refrigerator having a mounting structure capable of easily and conveniently achieving the mounting process for elements to be installed in an inner case. The refrigerator includes a first body including an inner case, an outer case, and a urethane foam filled between the inner case and the outer case, a coupling hole formed through the inner case, a mounting member coupled to the coupling hole at a first outside of the inner case by a first end of the mounting member and provided with a fastening hole, the mounting member being fixed between the inner case and the outer case by the urethane foam when the urethane foam is filled, and a fastening member fastened to the fastening hole at a first inside of the inner case.

2 Claims, 6 Drawing Sheets

REFRIGERATOR

CROSS-REFERENCE TO RELATED APPLICATION

This application claims the benefit of Korean Patent Application No. 10-2007-8508 filed on Jan. 26, 2007 in the Korean Intellectual Property Office, the disclosure of which is incorporated herein by reference.

BACKGROUND OF THE INVENTION

1. Field of the Invention

The present invention relates to a refrigerator, and, more particularly, to a refrigerator with an improved mounting structure for elements installed in an inner case.

2. Description of the Related Art

Generally, refrigerators are provided with a storage chamber which is cooled by cold air generated through an evaporator included in a refrigeration cycle, in order to store articles in a refrigerated or frozen state for a lengthy period of time.

The body of such a refrigerator includes an inner case defining a storage chamber as mentioned above in the interior of the inner case, an outer case forming an outer wall of the body, and an insulating layer formed between the inner case and the outer case to thermally insulate the storage chamber. The insulating layer is made of a urethane foam filled between the inner case and the outer case.

Typically, the storage chamber is partitioned into a freezing compartment and a refrigerating compartment. In the freezing compartment, the evaporator of the refrigeration cycle as mentioned above, an ice maker for making ice, etc. are installed. In the refrigerating compartment, a plurality of drawers and racks may be installed.

In order to mount such elements installed in the storage chamber, coupling holes are formed through the inner case. Also, mounting members are coupled to the coupling holes in such a manner that one end of each mounting member is inserted into an associated one of the coupling holes at the outside of the inner case. In this state, each mounting member is fixed between the inner case and the outer case by the urethane foam filled between the inner case and the outer case. Each mounting member is provided with a fastening hole formed through one end of the mounting hole.

When the urethane foam is filled between the inner case and the outer case in a state in which each mounting member has been coupled to the inner case, the mounting member is firmly fixed between the inner case and the outer case such that the inlet of the fastening hole of the mounting member is directed to the interior of the inner case. In this state, the above-mentioned elements can be mounted to the inner case by fastening members which are fastened to the fastening holes of the mounting members at the inside of the inner case.

In such a conventional refrigerator element mounting structure, however, there is a problem in that the urethane foam may leak into the interior of the inner case through the coupling holes in the process for filling the space between the inner case and the outer case with the urethane foam.

To this end, a new method has recently been proposed. In accordance with this method, a cover is provided at the outer surface of each mounting member to cover the coupling hole at the outside of the inner case. In the process for coupling the mounting member to the coupling hole, the cover is bonded to the outer surface of the inner case around the coupling hole by an adhesive such as a hot-melt. In this case, however, there is another problem in that the process for coupling the mounting member to the coupling hole becomes long and complex due to the addition of the hot-melt bonding process.

SUMMARY OF THE INVENTION

The present invention has been made in view of the above-mentioned problems, and an aspect of the invention is to provide a refrigerator having a mounting structure capable of easily and conveniently achieving the mounting process for elements to be installed in an inner case.

In accordance with one aspect, the present invention provides a refrigerator comprising a body including an inner case, an outer case, and a urethane foam filled between the inner case and the outer case, a coupling hole formed through the inner case, a mounting member coupled to the coupling hole at the outside of the inner case by one end of the mounting member and provided with a fastening hole, the mounting member being fixed between the inner case and the outer case by the urethane foam when the urethane foam is filled, and a fastening member fastened to the fastening hole at the inside of the inner case in a state of being coupled to an element to be installed in the interior of the inner case, to mount the element to the inner case, wherein: the mounting member comprises a cover for covering the coupling hole at the outside of the inner case; the mounting member is threadedly coupled to the coupling hole; the cover is pressed and deformed in accordance with the thread-coupling of the mounting member to the coupling hole such that the cover comes into close contact with an outer surface of the inner case around the coupling hole.

The mounting member may comprise a body including a front body and a rear body, the front body being coupled to the coupling hole. The cover may be formed on an outer peripheral surface of the body of the mounting member between the front body and the rear body such that the cover extends radially while being rearwardly convex. The mounting member may further comprise a plurality of spiral protrusions formed on an outer peripheral surface of the front body while being spaced apart from one another in a circumferential direction of the front body.

The coupling hole may comprise a first hole portion forming a central portion of the coupling hole, the first hole portion having a shape corresponding to a cross-sectional shape of the front body portion, to receive the front body portion, and a plurality of second hole portions formed around the first hole portion, each second hole portion having a shape corresponding to a cross-sectional shape of each spiral protrusion, to receive the spiral protrusion.

The refrigerator may further comprise a first rotation stopper formed on the outer peripheral surface of the front body portion behind the spiral protrusions, and a second rotation stopper formed on the outer surface of the inner case around the coupling hole such that the first and second rotation stoppers engage with each other to prevent the mounting member from rotating a predetermined angle or more.

The mounting member may be made of acrylonitrile-butadiene-styrene (ABS) resin. The cover may have a thin structure to have flexibility.

Additional aspects and/or advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the embodiments, taken in conjunction with the accompanying drawings in which.

DETAILED DESCRIPTION OF THE PREFERRED EMBODIMENTS

Reference will now be made in detail to the embodiments of the present invention, examples of which are illustrated in the accompanying drawings.

In accordance with an exemplary embodiment of the present invention, a refrigerator provided with a storage chamber is provided. The storage chamber of the refrigerator is cooled by cold air generated through an evaporator included in a refrigeration cycle, in order to store articles in a refrigerated or frozen state for a lengthy period of time.

Figure 1:
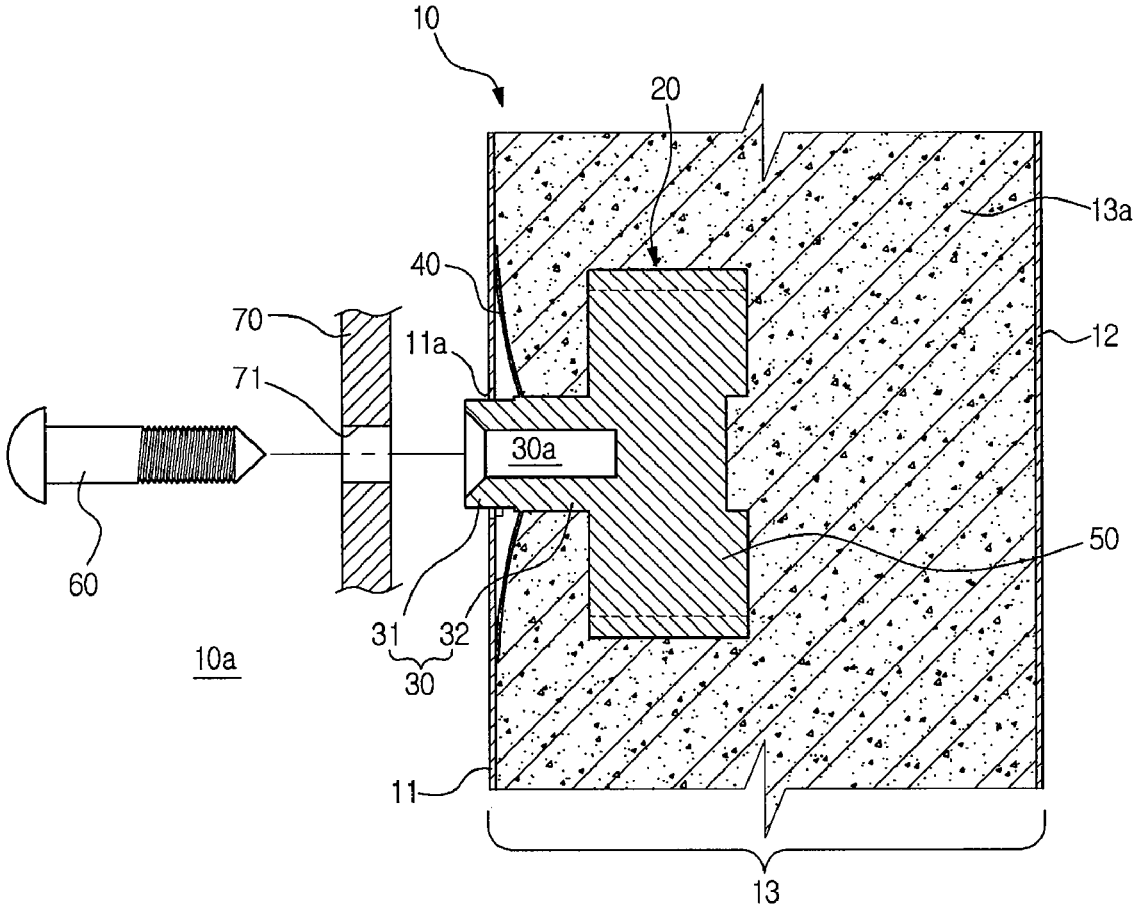
FIG. 1 is a sectional view illustrating a mounting structure for an element to be installed in the interior of an inner case in a refrigerator according to an exemplary embodiment of the present invention.
Figure 2:
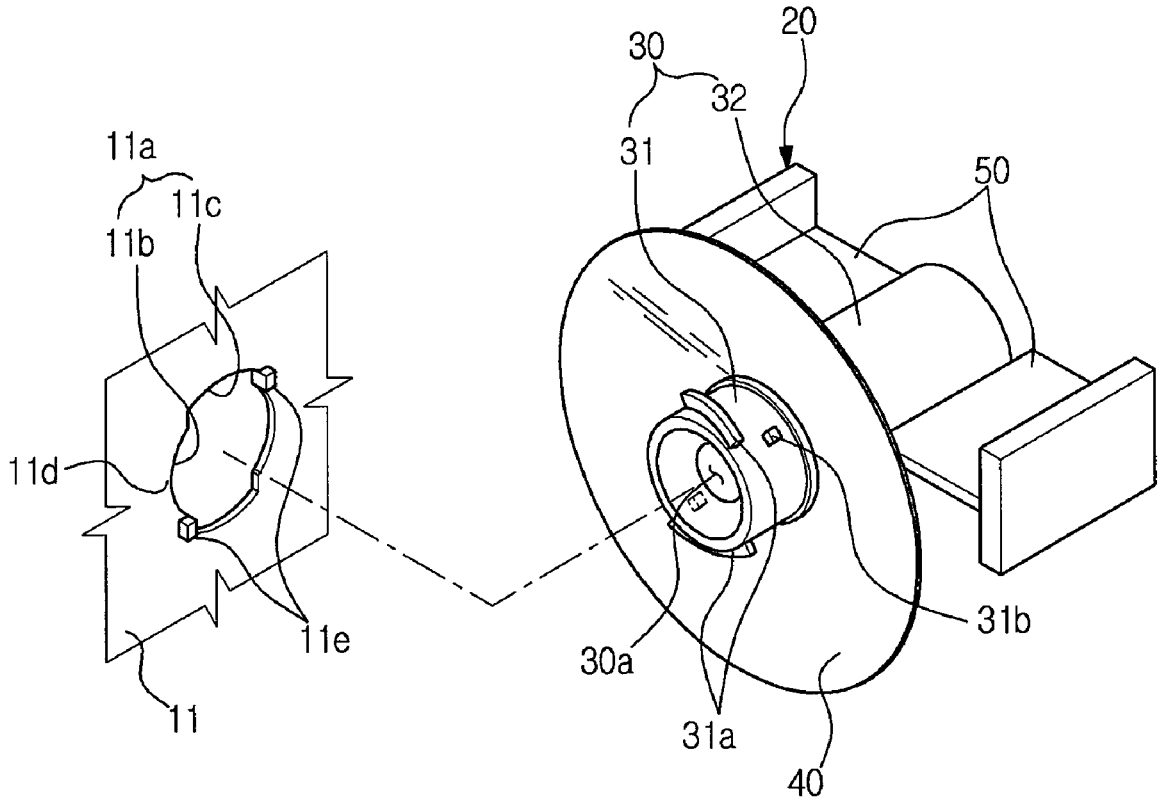
FIG. 2 is a perspective view illustrating structures of a mounting member and a coupling hole formed through the inner case which are used to mount the element in the refrigerator according to the exemplary embodiment of the present invention.

As shown in FIGS. 1 and 2, the refrigerator includes a body 10. The body 10 includes an inner case 11 defining a storage chamber 10*a* in the interior of the inner case 11, an outer case 12 forming an outer wall of the body 10, and an insulating layer 13 formed between the inner case 11 and the outer case 12 to thermally insulate the storage chamber 10*a*. The insulating layer 13 is made of a urethane foam filled between the inner case 11 and the outer case 12.

As in general cases, the storage chamber 10*a* is partitioned into a freezing compartment and a refrigerating compartment. In the freezing compartment, the evaporator (not shown) of the refrigeration cycle as described above, an ice maker (not shown) for making ice, etc. are installed. In the refrigerating compartment, a plurality of drawers (not shown) and racks (not shown) may be installed.

In order to mount such elements installed in the storage chamber 10*a*, the inner case 11 includes a mounting structure as follows.

That is, coupling holes 11*a* are formed through the inner case 11. Also, mounting members 20 provided with fastening holes 30*a* are coupled to the coupling holes 30*a* at the outside of the inner case 11. One end of each mounting member 20 is inserted into one of the coupling holes 11*a* at the outside of the inner case 11. In this state, each mounting member 20 is fixed between the inner case 11 and the outer case 12 by the urethane foam 13*a* filled between the inner case 11 and the outer case 12. A fastening member 60 is fastened to the fastening hole 30*a* at the inside of the inner case 11, in order to mount the associated element to the inner case 11.

Reference numeral 70 designates a coupling portion of one of the elements to be installed in the inner case 11. A coupling hole 71 is formed through the coupling portion 70, to allow the fastening member 60 to extend through the associated element.

When the urethane foam 13*a* is filled between the inner case 11 and the outer case 12 in a state in which each mounting member 20 has been coupled to the inner case 11, the mounting member 20 is firmly fixed between the inner case 11 and the outer case 12 such that the inlet of the fastening hole 30*a* of the mounting member 20 is directed to the interior of the inner case 11. In this state, the above-described elements can be mounted to the inner case 11 by the fastening members 60 which are fastened to the fastening holes 20*a* of the mounting members 20 at the inside of the inner case 11.

Meanwhile, each mounting member 20 is provided with a cover 40 to cover the coupling hole 11*a* at the outside of the inner case 11. The cover 40 functions to prevent the urethane foam 13*a* from leaking into the interior of the inner case 11 between the mounting member 20 and the coupling hole 11*a* during the process for filling the urethane foam 13*a* between the inner case 11 and the outer case 12. In the illustrated embodiment, the mounting member 20 is threadedly coupled to the coupling hole 11*a*. As the mounting member 20 is threadedly fastened to the coupling hole 11*a*, the cover 40 is deformed while being pressed against the outer surface of the inner case 11 around the coupling hole 11*a*. Thus, the cover 40 comes into close contact with the outer surface of the inner case 11.

In the refrigerator according to the illustrated embodiment, accordingly, it is possible to effectively prevent the urethane foam 13*a* from leaking into the interior of the inner case 11 between the mounting member 20 and the coupling hole 11*a* during the process for filling the urethane foam 13*a* between the inner case 11 and the outer case 12, without additionally using an adhesive or the like to bring the cover 40 into contact with the outer surface of the inner case 11 around the coupling hole 11*a*. This is because the mounting member 20 is coupled to the inner case 11 through a simple thread-fastening structure, and the cover 40 covers the coupling hole 11*a* while naturally coming into close contact with the outer surface of the inner case 11 in the above-described coupling procedure of the mounting member 20.

In detail, the mounting member 20 includes a cylindrical body 30. The fastening hole 30*a*, which will receive a fastening member 60 to fasten the mounting member 20, is formed in the body 30 such that the fastening hole 30*a* extends rearwardly from a front end of the body 30 to a certain depth.

The body 30 includes a front body portion 31 forming the front end of the body 30. The front body 31 is coupled to the coupling hole 11*a*. The body 30 also includes a rear body portion 32. A pair of wings 50 are formed at opposite sides of the rear body portion 32, in order to enable the user to easily rotate the mounting member 20 while grasping the mounting member 20. The cover 40 extends radially around the outer peripheral surface of the body 30 between the front body portion 31 and the rear body portion 32.

The cover 40 is thin, and is convex toward the rear side of the body 30. In order to enable the cover 40, which has the thin structure as described above, to be flexible, it is preferred that the overall portion of the mounting member 20 be made of acrylonitrile-butadiene-styrene (ABS) resin.

When the mounting member 20 is made of ABS resin, as described above, it is unnecessary to separately form threads on the inner peripheral surface of the fastening hole 30*a* for coupling the fastening member 60. This is because, although the fastening hole 30*a* has no separate thread, threads will be naturally formed on the inner peripheral surface of the fastening hole 30*a* by the fastening member 60, which is made of metal, in the fastening procedure of the fastening member 60 to the fastening hole 30*a*.

In order to enable the mounting member 20 to be threadedly coupled to the coupling hole 11*a*, a plurality of spiral protrusions 31*a* are formed on the outer peripheral surface of the front body portion 31 such that the spiral protrusions 31*a* are spaced apart from one another in a circumferential direction. In the illustrated embodiment, a pair of spiral protrusions 30*a* are formed on the front body portion 31.

Each spiral protrusion 31*a* extends to a certain length in the circumferential direction of the front body 31 while being uniformly inclined with respect to the circumferential direction of the front body 31. Thus, each spiral protrusion 31*a* has one end forwardly arranged in a longitudinal direction of the front body portion 31, and the other end rearwardly arranged in the longitudinal direction of the front body portion 31.

The coupling hole 11*a* includes a first hole portion 11*b* forming a central portion of the coupling hole 11*a*. The first hole portion 11*b* has a shape corresponding to the cross-sectional shape of the front body portion 31, in order to receive the front body portion 31. The coupling hole 11*a* also includes a pair of second hole portions 11*c* formed around the first hole portion 11*b*. Each second hole portion 11*c* has a shape corresponding to the cross-sectional shape of each spiral protrusion 31*a*, in order to receive the spiral protrusion 31*a*. In this case, the portions of the inner case 11 each arranged around the coupling hole 11*a* between the second hole portions 11*c* form engagement portions 11*d* which engage with the spiral protrusions 31*a* of the front body portion 31 when the spiral protrusions 31*a* rotate after being inserted into the second hole portions 11*c*, thereby preventing the front body portion 31 from being separated from the coupling hole 11*a* toward the outside of the inner case 11.

The distance between each spiral protrusion 31*a* and the cover 40 should be determined, taking into consideration the thickness of the inner case 11, in order to cause the cover 40 to come into close contact with the outer surface of the inner case 11 in a pressed state when the front body portion 21 is threadedly coupled to the coupling hole 11*a*.

When the front body portion 31 of the mounting member 20 is inserted into the coupling hole 11*a* such that the spiral protrusions 31*a* are inserted into respective second hole portions 11*c* of the coupling hole 11*a*, and then the mounting member 20 rotates such that the rear end of each spiral protrusion 31*a* engages with the inner surface of the associated engagement portion 11*d*, the mounting member 20 is firmly coupled to the coupling hole 11*a* while forwardly moving toward the interior of the inner case 11. Accordingly, the cover 40 comes into close contact with the outer surface of the inner case 11.

If the mounting member 20 further rotates from the state in which the rear end of each spiral protrusion 31*a* engages with the associated engagement portion 11*d*, there is a possibility that the spiral protrusion 31*a* moves to a position corresponding to one of the second hole portions 11*c* of the coupling hole 11*a*, so that the spiral protrusion 31*a* may be separated from the coupling hole 11*a* through the second hole portion 11*c* toward the outside of the inner case 11.

To this end, in order to prevent the mounting member 20 from rotating a predetermined angle or more, a first rotation stopper 31*b* is formed on the outer peripheral surface of the front body portion 21 behind each spiral protrusion 31*a*, and a second rotation stopper 11*e* corresponding to the first rotation stopper 31*b* is formed on the outer surface of the inner case 11 around the coupling hole 11*a* such that the first rotation stopper 31*b* and second rotation stopper 11*e* engage with each other when the mounting member 20 rotates the predetermined angle. Although two first rotation stoppers 31*b* and two second rotation stoppers 11*e* are provided in the illustrated case, only one first rotation stopper 31*b* and only one second rotation stopper 11*e* may be provided. Of course, a plurality of first and second rotation stoppers 31*b* and 11*e* may be provided.

In the illustrated embodiment, when the mounting member 20 rotates in the spiral direction of the spiral protrusions 31*a* in a state in which the spiral protrusions 31*a* have been inserted into the second hole portions 11*c*, the rear end of each spiral protrusion 31*a* comes into contact with one of the engagement portions 11*d*, so that they engages with each other. When the rotation angle of the mounting member 20 reaches about 90°, the first and second rotation stoppers 31*b* and 11*e* engage with each other. As a result, the mounting member 20 cannot further rotate.

Hereinafter, the procedure for mounting an element to be installed in the interior of the inner case 11 in the refrigerator according to the present invention will be described.

In order to mount the element to the inner case 11, the mounting member 20 is coupled to the coupling hole 11*a* before the urethane foam 13*a* is filled between the inner case 11 and the outer case 12, as shown in FIGS. 3 to 6.

Figure 3:
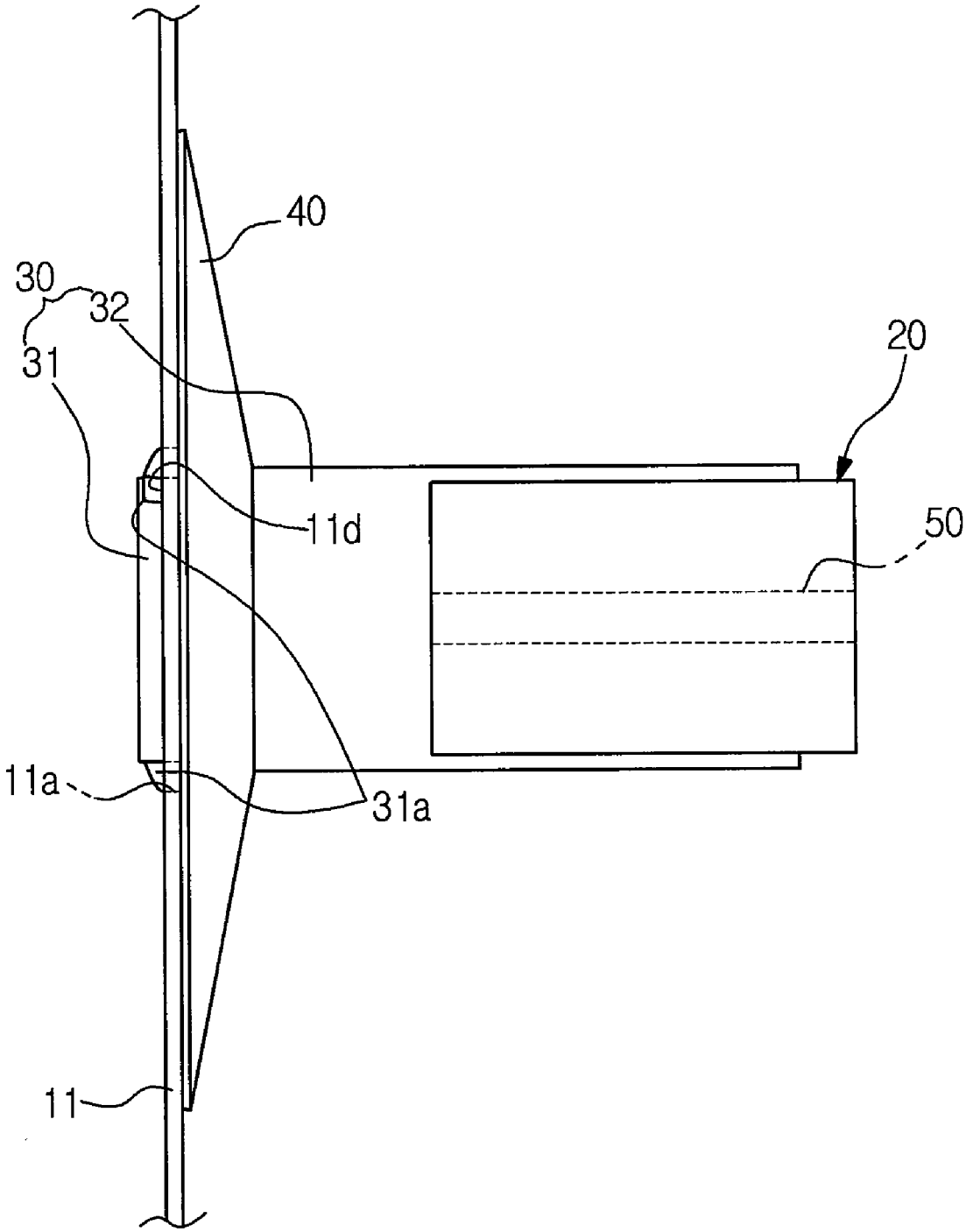
FIG. 3 is a sectional view illustrating a state in which the mounting member is inserted into the coupling hole in the refrigerator according to the exemplary embodiment of the present invention.
Figure 4:
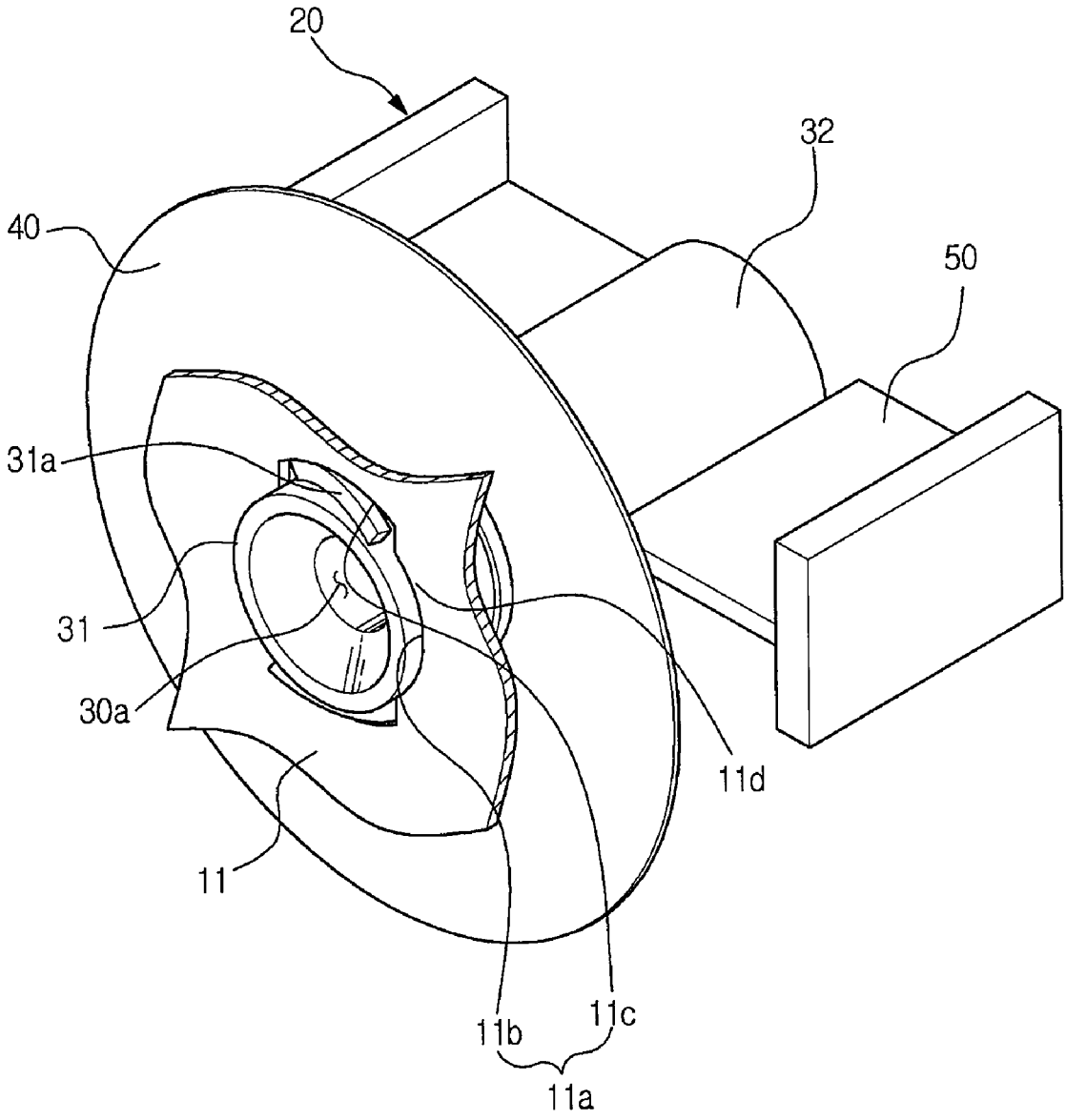
FIG. 4 is a perspective view illustrating a state in which the mounting member is inserted into the coupling hole in the refrigerator according to the exemplary embodiment of the present invention.

In the coupling process, the front body portion 31 of the mounting member 20 is first inserted into the coupling hole 11*a* such that each spiral protrusion 31*a* is inserted into an associated one of the second hole portions 11*c*, as shown in FIGS. 3 and 4. In the inserted state, the peripheral edge of the cover 40 is positioned close to the outer surface of the inner case 11, and the front end of each spiral protrusion 31*a* is positioned in the interior of the inner case 11.

Figure 5:
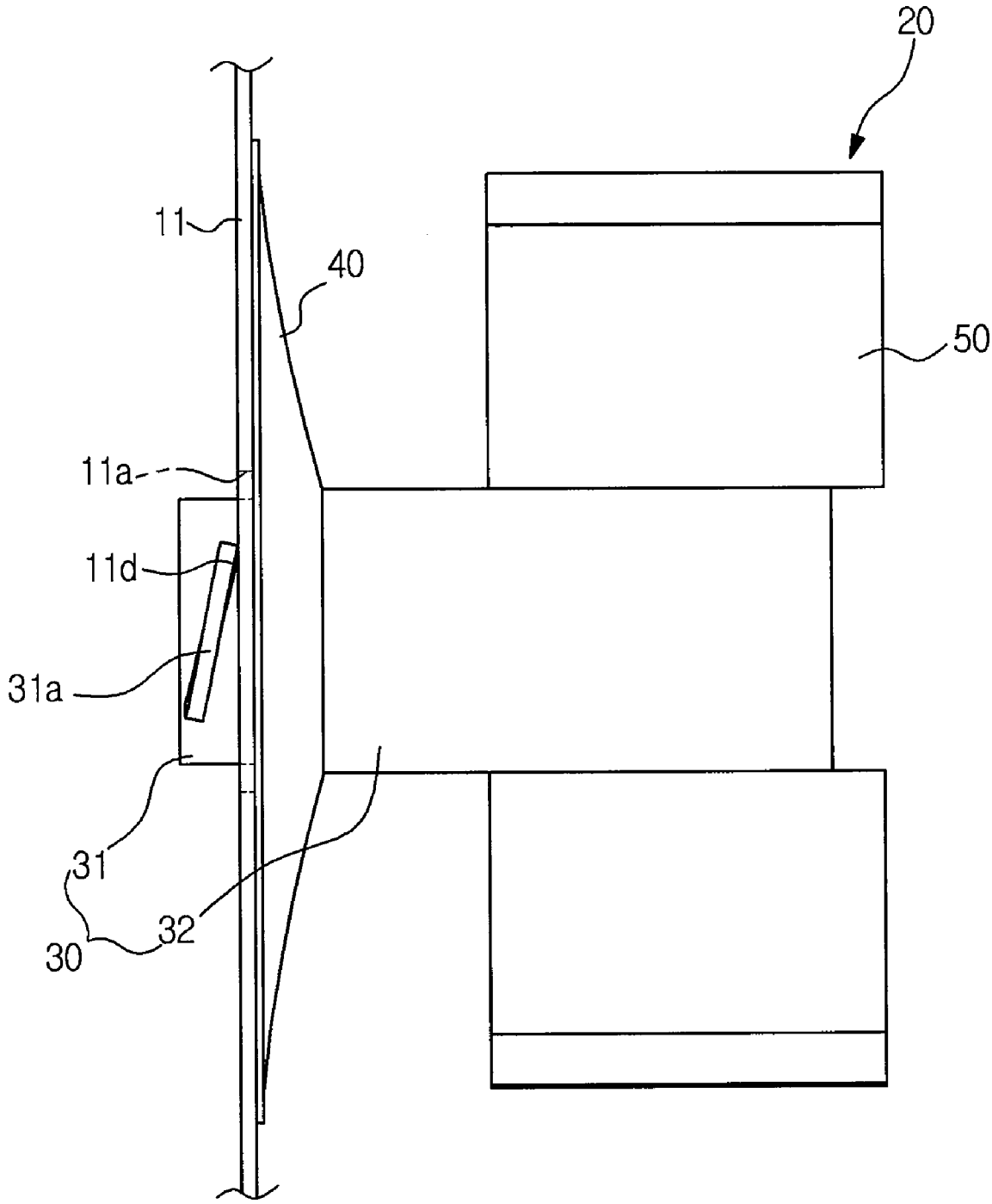
FIG. 5 is a sectional view illustrating a state in which the mounting member is threadedly coupled to the coupling hole in the refrigerator according to the exemplary embodiment of the present invention.
Figure 6:
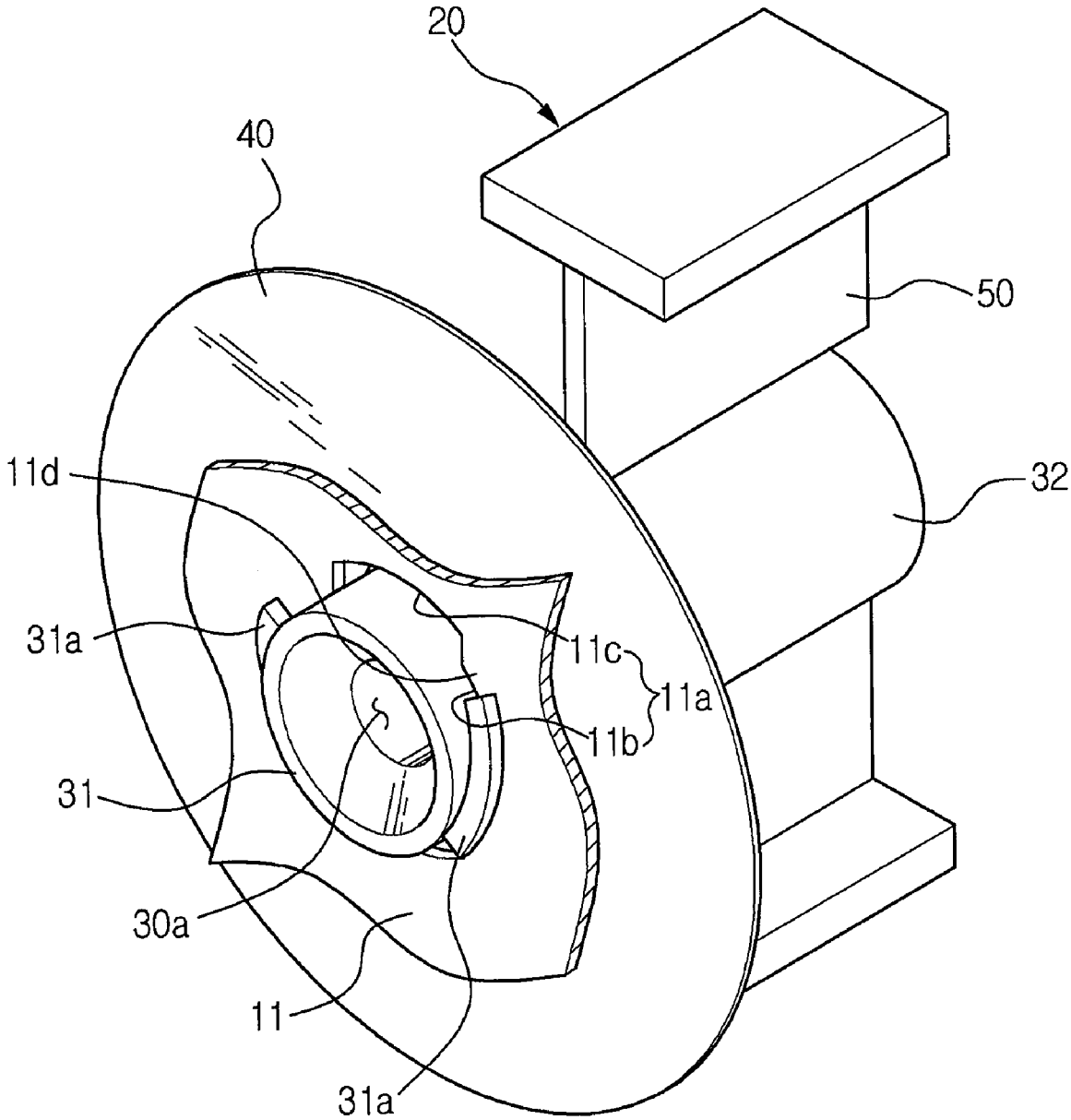
FIG. 6 is a perspective view illustrating a state in which the mounting member is threadedly coupled to the coupling hole in the refrigerator according to the exemplary embodiment of the present invention.

When the mounting member 20 rotates about 90° in the spiral direction of the spiral protrusions 31*a* from the above-described state, the rear end of each spiral protrusion 31*a* comes into contact with the inner surface of the associated engagement portion 11*d*, and the mounting member 20 moves forwardly, as shown in FIGS. 5 and 6. As a result, the cover 40 comes into close contact with the outer surface of the inner case 11 around the coupling hole 11*a* while being pressed and deformed.

When the rotation angle of the mounting member 20 reaches about 90°, the first and second rotation stoppers 31*b* and 11*e* engage with each other. As a result, the mounting member 20 cannot further rotate. Accordingly, there is no possibility that each spiral protrusion 31*a* is separated from the coupling hole 11*a* through the second hole portion 11*e*. Also, the operator can easily recognize the completion of the fastening of the mounting member 20.

After the coupling of the mounting member 20 to the coupling hole 11*a* is completed, the urethane foam 13*a* is filled between the inner case 11 and the outer case 12. As a result, the mounting member 20 is firmly fixed between the inner case 11 and the outer case 12 by the urethane foam 13*a*. In this case, the urethane foam 13*a* is prevented from leaking into the interior of the inner case 11 through the coupling hole 11*a* because the cover 40 has been pressed and deformed to come into close contact with the outer surface of the inner case 11, and thus to completely cover the coupling hole 11*a*.

In the state in which the coupling of the mounting member 20 has been completed, as described above, the element to be installed in the interior of the inner case 11 can be mounted to the inner case 11 by the fastening member 60 which is fastened to the fastening hole 30*a* after extending through the coupling hole 71 of the coupling portion 70 of the element.

As apparent from the above description, in the refrigerator according to the present invention, the coupling hole formed through the inner case is naturally sealed in the process for threadedly coupling the mounting member to the inner case. Accordingly, the refrigerator of the present invention has effects capable of easily achieving the coupling process for the mounting member, and reliably sealing the coupling hole by the cover without additionally using an adhesive. Thus, it is possible to easily and conveniently achieve the mounting process for elements to be installed in an inner case.

Although a few embodiments of the present general inventive concept have been shown and described, it will be appreciated by those skilled in the art that changes may be made in these embodiments without departing from the principles and spirit of the invention, the scope of which is defined in the appended claims and their equivalents.

What is claimed is:

1. A refrigerator, comprising:

a first body including an inner case, an outer case, and a urethane foam filled between the inner case and the outer case, a coupling hole formed through the inner case, a mounting member coupled to the coupling hole on a first outside of the inner case by a first end of the mounting member and provided with a fastening hole, the mounting member being fixed between the inner case and the outer case by the urethane foam when the urethane foam is filled, and a fastening member fastened to the fastening hole at a first inside of the inner case in a state of being coupled to an element to be installed in an interior of the inner case, to mount the element to the inner case, wherein the mounting member comprises a cover for covering the coupling hole at the first outside, the mounting member is threadedly coupled to the coupling hole, and wherein the cover is pressed and deformed in accordance with a thread-coupling of the mounting member to the coupling hole such that the cover comes into close contact with an outer surface of the inner case around the coupling hole, and wherein the mounting member comprises a second body including a front body and a rear body, the front body being coupled to the coupling hole, and wherein the cover is formed on an outer peripheral surface of the second body between the front body and the rear body such that the cover extends radially while being rearwardly convex, and the mounting member further comprises a plurality of spiral protrusions formed on an outer peripheral surface of the front body, each one of the plurality of spiral protrusions being spaced apart from one another in a circumferential direction of the front body, wherein the coupling hole comprises:

a first hole portion forming a central portion of the coupling hole, the first hole portion having a shape corresponding to a cross-sectional shape of the front body portion, to receive the front body portion; and a plurality of second hole portions formed around the first hole portion, each one of the plurality of second hole portions having a shape corresponding to a cross-sectional shape of each one of the plurality of spiral protrusions, to receive each one of the plurality of spiral protrusions, wherein the refrigerator further comprises:

a first rotation stopper formed on the outer peripheral surface apart from the plurality of spiral protrusions; and a second rotation stopper formed on an outer surface of the inner case around the coupling hole and protruded backward from the coupling hole such that the first and second rotation stoppers engage with each other to prevent the mounting member from rotating a predetermined angle or more.

2. The refrigerator according to claim 1, wherein the mounting member is made of acrylonitrile-butadiene-styrene (ABS) resin, and the cover has a thin structure to have flexibility.

* * * * *